US009272831B2

(12) United States Patent
Julius et al.

(10) Patent No.: US 9,272,831 B2
(45) Date of Patent: Mar. 1, 2016

(54) DISPENSER

(75) Inventors: Robert P. Julius, Greenwich, CT (US); Gerard Anthony Cahalan, New Milford, CT (US)

(73) Assignee: Nice-Pak Products, Inc., Orangeburg, NY (US)

( * ) Notice: Subject to any disclaimer, the term of this patent is extended or adjusted under 35 U.S.C. 154(b) by 0 days.

(21) Appl. No.: 13/586,734

(22) Filed: Aug. 15, 2012

(65) Prior Publication Data

US 2014/0048553 A1 Feb. 20, 2014

(51) Int. Cl.

*B65D 77/00* (2006.01)
*B65D 75/58* (2006.01)
*B65D 43/16* (2006.01)
(Continued)

(52) U.S. Cl.

CPC ..... *B65D 75/58* (2013.01); *B65D 43/16* (2013.01); *B65D 75/56* (2013.01); *B65D 83/0805* (2013.01); *B65D 2543/00194* (2013.01); *B65D 2543/00296* (2013.01); *B65D 2543/00435* (2013.01)

(58) Field of Classification Search

CPC . A47K 10/421; A61K 8/208; B65D 83/0805; B65D 5/6697; B65D 1/44; B65D 1/42; B65D 43/065; B65D 43/06; B65D 43/08; B65D 2543/00064; B65D 2543/00231; B65D 2543/00537; B65D 2543/0087; B65D 2543/00842; B65D 2543/0062; B65D 75/56; B65D 75/58; B65D 43/16; B65D 2543/00194; B65D 2543/00296; B65D 2543/00435

USPC ..... 383/66; 206/494, 37, 581, 233, 216; 221/186; 222/424.5; 220/740, 802, 220/839, 758, 4.24, 4.25, 669–674, 659, 220/658, 657, 656, 640, 639, 810, 200, 771, 220/631; D9/456; 264/478, 453

See application file for complete search history.

(56) References Cited

U.S. PATENT DOCUMENTS

| | | | |
|---|---|---|---|
| 2,841,275 | A | 7/1958 | Schwimmer et. al. |
| 2,841,276 | A | 7/1958 | Schwimmer et al. |
| 3,033,362 | A | 5/1962 | Marcalus |

(Continued)

FOREIGN PATENT DOCUMENTS

| | | | |
|---|---|---|---|
| CA | 2 269 379 | A1 | 10/2000 |
| EP | 0371539 | A2 | 6/1990 |
| EP | 0583831 | A1 | 2/1994 |

OTHER PUBLICATIONS

International Search Report and Written Opinion dated Sep. 6, 2013, International Application No. PCT/US13/54537, 9 pages.

*Primary Examiner* — Anthony Stashick
*Assistant Examiner* — James M Van Buskirk
(74) *Attorney, Agent, or Firm* — Lewis Roca Rothgerber Christie LLP

(57) ABSTRACT

A dispenser includes a container having an opening; and a cover coupled to the container and configured to cover the opening, the cover including a base coupled to the container, the base having side walls defining an interior opening; a first tab and a second extending outwardly in a first direction from a first one of the side walls, wherein the second tab is spaced from and substantially parallel to the first tab, a third tab and a fourth tab extending outwardly in a second direction substantially opposite to the first direction from a second one of the side walls, wherein the fourth tab is spaced from and substantially parallel to the third tab; and a lid tray rotatably coupled to the base and configured to cover the interior opening.

15 Claims, 2 Drawing Sheets

(51) Int. Cl.
*B65D 75/56* (2006.01)
*B65D 83/08* (2006.01)

(56) References Cited

U.S. PATENT DOCUMENTS

| | | | | | |
|---|---|---|---|---|---|
| 3,141,569 | A | | 7/1964 | Hanson | |
| 3,331,498 | A | | 7/1967 | Davies | |
| 3,448,888 | A | * | 6/1969 | Collie et al. | 220/781 |
| 3,825,049 | A | * | 7/1974 | Swett et al. | 220/771 |
| 4,022,319 | A | | 5/1977 | Jenkins | |
| 4,216,763 | A | * | 8/1980 | Miklas | 126/275 R |
| 4,469,243 | A | | 9/1984 | Ito et al. | |
| 4,879,442 | A | | 11/1989 | Giovine | |
| 5,054,612 | A | | 10/1991 | Meyer, Jr. | |
| 5,145,088 | A | * | 9/1992 | Goujon | 220/837 |
| 5,210,906 | A | * | 5/1993 | Aihara et al. | 16/232 |
| 5,667,092 | A | | 9/1997 | Julius et al. | |
| 6,092,687 | A | * | 7/2000 | Hupp et al. | 220/666 |
| 6,343,707 | B2 | * | 2/2002 | Cheng | 220/4.24 |
| 6,478,181 | B1 | * | 11/2002 | Krupa et al. | 220/573.1 |
| 6,499,626 | B1 | | 12/2002 | Julius | |
| 6,571,985 | B2 | | 6/2003 | Wilkes et al. | |
| 6,672,474 | B2 | | 1/2004 | May et al. | |
| 6,688,483 | B2 | * | 2/2004 | Davis | 220/276 |
| 6,702,109 | B1 | * | 3/2004 | Tabuchi | 206/233 |
| 6,702,147 | B2 | | 3/2004 | Ashford | |
| 6,863,192 | B2 | | 3/2005 | Tumlinson | |
| 7,416,083 | B2 | * | 8/2008 | Bando | 206/494 |
| 7,490,734 | B2 | | 2/2009 | Carr | |
| 7,832,555 | B2 | | 11/2010 | Flannery | |
| 2009/0152290 | A1 | | 6/2009 | Wang et al. | |
| 2009/0223993 | A1 | | 9/2009 | Lorenzati | |
| 2010/0258580 | A1 | | 10/2010 | Decker et al. | |

* cited by examiner

DISPENSER

FIELD

Embodiments of the present invention are generally directed to dispensers for articles, and particularly to a cover for such dispensers.

BACKGROUND

Dispensers for articles such as tissues and wet wipes are well known in the art. Such articles may be provided as moistened, but also dry or with lotion, and are often generally rectangular in shape and supplied interleaved, as discrete sheets, or separably connected. Dispensers for such articles are typically in box form, i.e., in the shape of a parallelepiped, wherein the box has an opening through which the articles can be removed. The opening of the dispenser can be covered by a lid that may be opened by, for example, being cut along a perforated edge, having an adhesive that may be sealed and unsealed repeatedly, or by having a hinged cover that can be opened and closed repeatedly.

Although the container and cover may be used together without being coupled to any other structure, often is it desirable for the container to be attached to another assembly, such as a wall or table mount, a warmer, or a disposal, among others. Although the container may be coupled directly to such assembly, such as by being accommodated within a space of the assembly, because the container may comprise a flexible material and be subjected to forces applied by a user removing wipes from the container, the container may become dislodged or otherwise separated from the assembly if attached directly, particularly as the number of wipes within the container is reduced.

SUMMARY

A dispenser includes a container having an opening; and a cover coupled to the container and configured to cover the opening, the cover having a base coupled to the container and a lid tray rotatably coupled to the base and configured to cover the interior opening. In one embodiment, the base includes side walls defining an interior opening; a first tab extending outwardly in a first direction from a first one of the side walls, a second tab extending outwardly in the first direction from the first one of the side walls, wherein the second tab is spaced from and substantially parallel to the first tab, a third tab extending outwardly in a second direction substantially opposite to the first direction from a second one of the side walls, and a fourth tab extending outwardly in the second direction from the second one of the side walls, wherein the fourth tab is spaced from and substantially parallel to the third tab.

In one embodiment, the first tab and the third tab have a notch and the second tab and the fourth tab are generally aligned with the notch of the first tab and the third tab, respectively. Further, the first tab and the third tab may extend from an upper edge of the first side wall and the second side wall, respectively, and the second tab and the fourth tab may extend from a lower edge of the first side wall and the second side wall, respectively. Additionally, the lid tray may have an interior wall at least partially spaced from an edge of the lid tray and which is configured to contact an interior of the side walls of the base.

DETAILED DESCRIPTION

In general, embodiments of the present invention are directed to a dispenser having a cover intended to be used with a container containing articles stacked together, the articles configured to be individually removed from the container through the cover. Specifically, the following description focuses on one of the many possible applications for use of the dispenser, namely, for holding and dispensing moist tissue wipes. However, it will be appreciated that the cover and container are not limited to the described applications, but rather could be used for a variety of applications.

According to embodiments of the dispenser of the present invention, the cover is configured to be coupled to another assembly, for example, a wall or table mount, a warmer, or a disposal, among others, to allow the dispenser to be securely and removably coupled to such assembly such that all of the articles within the dispenser can be easily removed therefrom without dislodging the dispenser from the assembly. According to embodiments of the present invention, by attaching the cover of the dispenser to the assembly, rather than merely accommodating the container in the assembly, the dispenser can remain coupled to the assembly even when a significant force is applied to the dispenser as wipes are removed from the container, even if only a few wipes remain in the container.

Figure 1:
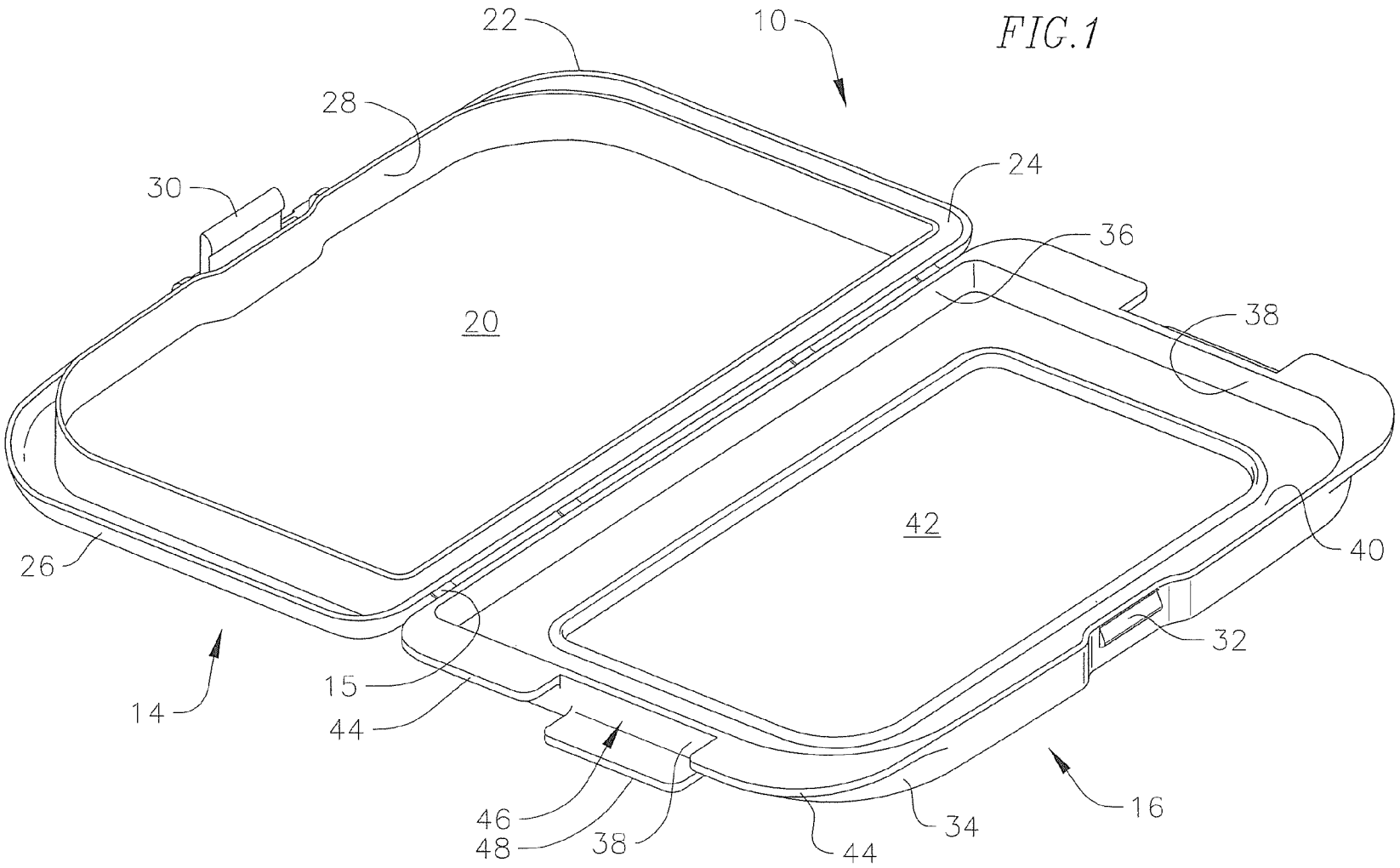
FIG. 1 is a perspective view of a cover for a dispenser according to an embodiment of the present invention.
Figure 2:
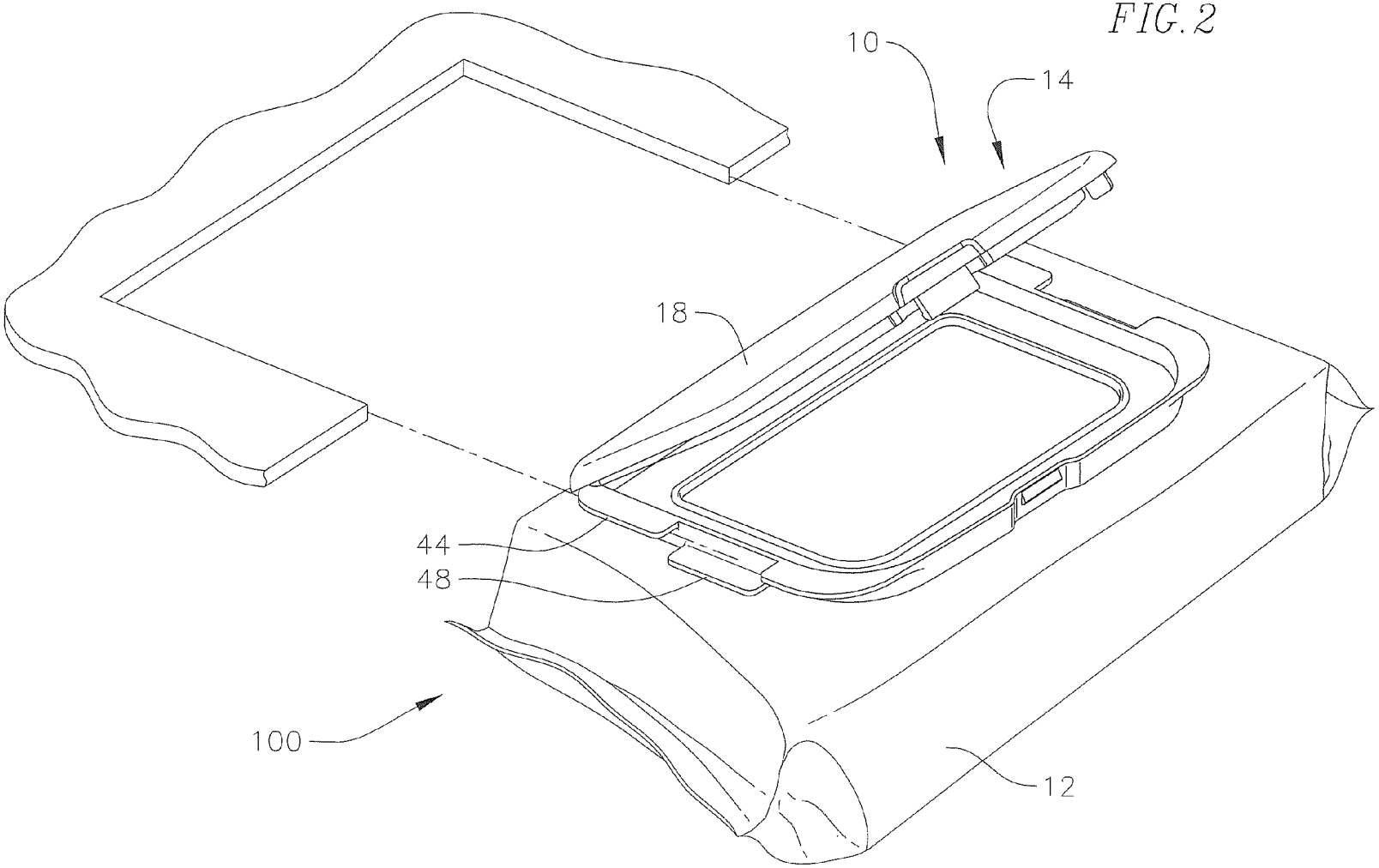
FIG. 2 is a perspective view of the cover of FIG. 1 coupled to a container according to an embodiment of the present invention.

With reference to FIGS. 1 and 2, a dispenser 100 includes a cover 10 configured to be attached to a container 12 housing articles, such as moist wipes. The cover 10 can be coupled to the container 12 by being, for example, hot-melted onto the container along a bottom surface as is well-known. However, it will be appreciated that the cover 10 could also be attached to the container 12 by any number of other ways to establish a permanent or temporary connection between the cover and the container, or the cover and the container may be integral as a single piece.

The container 12 may generally be configured to house a number of articles and may be generally box-shaped. In one embodiment, the container 12 may be made from a relatively flexible resin material, however it will be appreciated that any container configured to house articles may be used in connection with embodiments of the present invention, and the shape, configuration, and materials of the container are not limited to those described herein.

In one embodiment, the cover 10 is made from a relatively rigid resin material that will allow it to support the dispenser 100 when the dispenser is coupled to another assembly by using the cover, as described below. The cover 10 includes a lid tray 14 connected by a hinge 15 to a base 16 that is fixedly coupled to the container 12. The lid tray 14 has a top face 18, a bottom face 20, and a peripheral side wall 22 extending from the top and bottom faces 18, 20. In one embodiment, the peripheral side wall 22 is integral with and is substantially perpendicular to the top and bottom faces 18, 20 of the lid tray 14. Further, the peripheral side wall 22 defines an inside surface 24 and an outside surface 26, wherein the outside surface is configured to be substantially flush with a periphery of the base 16 when the lid tray 14 is in a closed position, as described in more detail below.

The lid tray 14 further includes an interior wall 28 extending from the bottom face 20. In one embodiment, the interior wall 28 extends to form a loop and is substantially parallel to the peripheral side wall 22. At least a portion of the interior wall 28 is spaced from the peripheral side wall 22 and, as will be described in more detail below, the interior wall is configured to form an interference fit with the base 16 to maintain the lid tray 14 in the closed position.

In one embodiment, a latch 30 extends from a portion of the peripheral side wall 22, the latch being configured to engage a ridge 32 on the base 16. The latch 30 may be integral with the lid tray 14 and may be configured to bend outwardly to slide over the ridge 32 and be biased to engage the ridge in a locking manner. As such, the lid tray 14 can be locked to the base 16 in the closed position. The latch 30 can be released from the ridge 32 by being bent away from the ridge and then by rotating the lid tray 14 away from the base 16. As will be appreciated, any type of latch or other locking mechanism can be used in connection with embodiments of the dispenser of the present invention, which is not limited to the latch 30 described herein.

The lid tray 14 and the base 16 are rotatably connected by the hinge 15. In one embodiment, the hinge 15 may be a living hinge wherein the hinge in integral with and made from the same material as the cover and the base. The hinge 15 may be continuous along a portion of or along an entirety of an edge of the lid tray 14 and/or the base 16 or the hinge may comprise a plurality of sections spaced from each other to reduce the stress on the hinge when the cover is opened and closed. Alternatively, a conventional hinge using multiple structures as is well-known, such as a barrel hinge, among others, can be used to rotatably couple the lid tray 14 to the base 16. Although the cover 10 is described as having a lid tray 14 rotatably coupled thereto, it will be appreciated that the lid tray could also be removably coupleable to the base 16. Further, the lid tray 14 may be omitted entirely such that the "cover" would include the base and leave an opening in the container exposed. In other words, when used without the lid tray 14, the base 16 would provide a structure to allow the base, and any container or package attached to the base, to be coupled to an outside structure similarly to if the lid tray were attached to the base.

The base 16 is defined by a front wall 34, a rear wall 36, and side walls 38 each having interior and exterior-facing surfaces. An interior flange 40 extends substantially perpendicularly from the interior-facing surface of the walls 34, 36, 38 and defines an opening 42 configured to allow articles to be removed from the container 12 attached to the cover 10. As shown, the opening 42 is substantially rectangular and sized to encompass a significant area of the base, but it will be appreciated that the opening could be smaller and also be of a different shape or configuration depending on the application of the cover 10 or that the opening could be entirely omitted.

Tabs configured to be accommodated on an outside assembly coupled to the dispenser 100 extend outwardly from the opposing side walls 38 of the base 16. Generally, the tabs provide a support structure that allows the base 16, and thereby any container or packaging coupled to the base, to be securely coupled to the outside assembly. Specifically, the tabs allow the base 16 to be secured against the outside assembly with respect to forces generally orthogonal to the tabs, i.e., forces that are applied to the base when, for example, inserting to removing articles from a container attached to the base or opening or closing the lid tray 14 of the base.

In one embodiment, upper tabs 44 extend from an upper portion of the side walls 38 in a direction substantially perpendicular to the side walls. The upper tabs 44 are dimensioned to have a width wide enough to couple the dispenser 100 onto the outside assembly and to secure it against the force applied by a user closing the lid tray 14. In other words, the upper tabs 44 brace the base 16 against a wall or other surface of the outside assembly to prevent the base from being dislodged or dislocated when the lid tray 14 is closed. Further, in one embodiment, the upper tabs 44 extending along each side wall 38 are separated from each other by a notch 46. However, it will be appreciated that the upper tab 44 could extend continuously along the entire side wall 38 or that a plurality of notches could divide the upper tab 44 into more than two tabs. Additionally, as shown the upper tabs 44 are substantially planar and extend substantially orthogonally to a side wall of the base 16. However, it will be appreciated that the upper tabs 44 could have other non-linear cross-sections, such as an arc, serpentine, or triangular cross-section and that they could extend from the side wall at an angle other than substantially a right angle.

Lower tabs 48 extend from a lower portion of the side walls 38 such that the lower tabs 48 are spaced from and extend generally parallel to corresponding upper tabs 44 extending from the same side wall. Similarly to the upper tabs 44, the lower tabs 48 extend substantially perpendicularly to the side wall 38 and are dimensioned to have a width wide enough to couple the dispenser 100 onto the outside assembly and to secure it against the force applied by a user removing articles from the container 12, even when only a few articles remain in the container 16 or in other cases when the container alone would not support a force applied thereto. In one embodiment, each respective lower tab 48 generally corresponds to the notch 46 between the upper tabs 44 extending from the same side wall 38, i.e., the lower tab and the upper tab do not overlap. However, it will be appreciated that the lower tab 48 could extend continuously along the entire side wall 38 or that a plurality of notches could divide the lower tab 48 into two or more tabs. Additionally, as shown the lower tabs 48 are substantially planar and extend substantially orthogonally to a side wall of the base 16. However, it will be appreciated that the lower tabs 48 could have other non-linear cross-sections, such as an arc, serpentine, or triangular cross-section and that they could extend from the side wall at an angle other than substantially a right angle.

In one embodiment, the cover 10 may be injection molded as is well-known. However, due to the injection molding process, it may not be optimal to form a cover 10 having the upper and lower tabs 44, 48 overlapping each other. As such, as described above, the upper tab 44 may have a notch 46 located to generally correspond to the lower tab 48 so that the base 16 may be easily removed from the mold. However, as noted above, the base 16 may also be manufactured so that the upper and lower tabs 44, 48 extend continuously along the side walls 38.

Operation of the cover will now be described. The cover 10 is configured to cover an opening of the container 12 and also to provide support so that the dispenser 100 can be securely coupled to an outside assembly. As such, the upper and lower tabs 44, 48 spaced from each other and extending substantially in parallel from opposite side walls 38 of the base provide a structure configured to accommodate a flange or ridge therebetween. As shown in FIG. 2, the cover 10, and therefore, any container 12 coupled to the cover, can slide on to another outside assembly or apparatus having a structure spaced appropriately to be accommodated within the upper and lower tabs 44, 48. When the cover 10 is coupled by its tabs 44, 48 to the flange, a force applied to the cover generally perpendicularly to the tabs in either direction will not dislodge the cover from the flange. However, unless otherwise locked in place, the cover can be easily removed from the flange by sliding it along the flange.

Additionally, the lid tray 14 can be rotated on the hinge 15 between an open and closed position. In the open position, the opening 42 is exposed to allow articles to be removed from the container 12. In the closed position, the interior wall 28 abuts an inside of at least one of the side walls 38 of the base 16 to form an interference fit. Additionally, the latch 30 and the ridge 32 can interact to form a lock. Further, the inside surface 24 of the peripheral side wall 22 of the lid tray 14 can abut a periphery of the upper and/or lower tabs 44, 48 to further support the cover in the closed position.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A dispenser comprising:

a container having an opening; and a base coupled to the container, the base comprising:

side walls defining an interior opening; and a plurality of tabs comprising:

a first tab extending outwardly in a first direction from a first one of the side walls, a second tab extending outwardly in the first direction from the first one of the side walls, wherein the second tab is spaced to extend entirely on a different plane from the first tab;

a third tab extending outwardly in a second direction substantially opposite to the first direction from a second one of the side walls, and a fourth tab extending outwardly in the second direction from the second one of the side walls, wherein the fourth tab is spaced to be on a different plane from the third tab, wherein the first tab and the third tab each have a notch and wherein the second tab and the fourth tab are generally aligned with the notch of the first tab and the third tab, respectively, such that none of the tabs overlap each other in a direction along the side walls extending perpendicularly to the first and second directions.

2. The dispenser of claim 1, wherein the second tab is substantially parallel to the first tab.

3. The dispenser of claim 1, wherein the first tab and the third tab extend from an upper edge of the first one and the second one of the side walls, respectively.

4. The dispenser of claim 1, wherein the second tab and the fourth tab extend from a lower edge of the first one and the second one of the side walls, respectively.

5. The dispenser of claim 1, further comprising a lid tray coupleable to the base and configured to cover the interior opening.

6. The dispenser of claim 5, wherein the lid tray comprises an interior wall at least partially spaced from an edge of the lid tray.

7. The dispenser of claim 6, wherein the interior wall is configured to contact an interior of the side walls of the base.

8. The dispenser of claim 5, wherein the lid tray and the base are coupled by a hinge.

9. A cover for a container, the cover comprising:

a base comprising:

side walls defining an interior opening; and a plurality of tabs comprising:

a first tab extending outwardly in a first direction from a first one of the side walls, a second tab extending outwardly in the first direction from the first one of the side walls, wherein the second tab is spaced to extend entirely on a different plane from the first tab, a third tab extending outwardly in a second direction substantially opposite to the first direction from a second one of the side walls, and a fourth tab extending outwardly in the second direction from the second one of the side walls, wherein the fourth tab is spaced to be on a different plane from and is substantially parallel to the third tab, wherein the first tab and the third tab each have a notch and wherein the second tab and the fourth tab are generally aligned with the notch of the first tab and the third tab, respectively, such that none of the tabs overlap each other in a direction along the side walls extending perpendicularly to the first and second directions; and a lid tray coupleable to the base and configured to cover the interior opening.

10. The cover of claim 9, wherein the first tab and the third tab extend from an upper edge of the first one and the second of the side walls, respectively.

11. The cover of claim 9, wherein the second tab and the fourth tab extend from a lower edge of the first one and the second one of the side walls, respectively.

12. The cover of claim 9, wherein the lid tray comprises an interior wall at least partially spaced from an edge of the lid tray.

13. The cover of claim 12, wherein the interior wall is configured to contact an interior of the side walls of the base.

14. The cover of claim 9, wherein the lid tray and the base are coupled by a hinge.

15. The cover of claim 9, wherein the second tab is substantially parallel to the first tab.

* * * * *